US008256353B1

(12) United States Patent
Howell

(10) Patent No.: US 8,256,353 B1
(45) Date of Patent: Sep. 4, 2012

(54) SYSTEM AND METHOD FOR PROCESSING AND DISTRIBUTING FREIGHT CONTAINERS

(76) Inventor: Bradley N. Howell, Houston, TX (US)

( * ) Notice: Subject to any disclaimer, the term of this patent is extended or adjusted under 35 U.S.C. 154(b) by 1467 days.

(21) Appl. No.: 10/071,892

(22) Filed: Feb. 8, 2002

(51) Int. Cl.
*B61J 3/00* (2006.01)

(52) U.S. Cl. ..... 104/88.01

(58) Field of Classification Search ..... 104/26.1, 104/27, 29; 246/2 R, 20; 414/333, 339
See application file for complete search history.

(56) References Cited

U.S. PATENT DOCUMENTS

| | | | | |
|---|---|---|---|---|
| 3,638,576 | A * | 2/1972 | Schauffler | 104/307 |
| 5,623,413 | A | 4/1997 | Matheson et al. | |
| 5,794,172 | A | 8/1998 | Matheson et al. | |
| 5,797,113 | A | 8/1998 | Kambe et al. | |
| 5,828,979 | A | 10/1998 | Polivka et al. | |
| 5,836,529 | A | 11/1998 | Gibbs | |
| 6,165,283 | A * | 12/2000 | Dahlin et al. | 134/21 |
| 6,418,854 | B1 * | 7/2002 | Kraft | 104/26.1 |
| 6,446,912 | B1 * | 9/2002 | Barich et al. | 246/2 R |
| 6,516,727 | B2 * | 2/2003 | Kraft | 104/26.1 |

* cited by examiner

*Primary Examiner* — S. Joseph Morano
*Assistant Examiner* — R. J. McCarry, Jr.
(74) *Attorney, Agent, or Firm* — Locke Lord LLP

(57) ABSTRACT

A system and method for optimally managing the inventory of railroad freight cars and for transporting and processing the unladen cars to reloading points. The system provides a means for returning unladen cars at one or more strategically located yards or aggregation facilities where the cars are cleaned, inspected, repaired/maintained, stored and blocked for ultimate delivery. After such processes the cars may be treated as generic, and used for the transport of any materials within the constraints of the car type, rather than being dedicated to specific products and returned to a specific production facilities as in current practice. As well, the method provides a means by which multiple car operators may pool their collective rail car assets to further optimize the rail car supply chain. The method provides a means to determine candidate locations for such aggregation facilities/processing yards, and for optimal inventory control, sorting by next destination, and transit scheduling to deliver unladen cars to their next reloading points. The system and method are particularly useful in transporting specific polymer resins to a manufacturing region and returning the rail car through the aggregation/processing facility such that the cleaned, repaired, inspected, stored and blocked car may be used at any resin production facility.

32 Claims, 5 Drawing Sheets

SYSTEM AND METHOD FOR PROCESSING AND DISTRIBUTING FREIGHT CONTAINERS

BACKGROUND OF THE INVENTION

1. Field of the Invention

The present invention relates to the placement, design and use of centralized, aggregating, freight container cleaning, maintenance, repair, and redistribution facilities in particular to improve the supply chain management of railroad freight car assets and the timely redistribution of laden and unladen cars to points on a railroad network.

2. Description of Related Art

In current railroad freight traffic operations involving movement of freight cars, stress is placed on path planning to implement the efficient transit of laden cars from loading points to delivery destinations (consignees). Once they have been unloaded at the consignees, the empty cars must be moved to the next loading point before they can be re-used.

One problem preventing the efficient movement of freight cars is congestion in the rail transportation system. In existing industry operating practice for rail cars it is customary to generate the transit path for return of the unladen cars by simply reversing the path of the loaded cars. Relative to the planning which is applied to the efficient delivery of loaded cars, insufficient little attention has been paid to exploring alternative and possibly more efficient paths for the movement of the unladen cars. Instead, the movement of unladen (empty) railway freight cars are not seen as "revenue generating moves" by the rail carriers, and therefore the transit of empty freight cars back to the loading point is generally of lesser priority than the movement of outbound laden cars. One result is an excess number of unladen freight cars which leads to congestion, which further delays the transit times for unladen freight cars returning to loading points and the transit times of laden cars moving to consignees.

In one attempt to reduce the number of cars on the railroad system, rail carriers often charge demurrage for cars that cannot be placed within a shipper's facility. These charges are punitive in nature and do not solve a fundamental problem of a lack of railroad infrastructure.

Another attempt to alleviate the congestion is through the use of third party capital to help build railcar storage infrastructure. However, most of these applications have been customer-specific or have focused on the storage of loaded cars and have done little to improve overall rail system velocity or rail carrier service plan improvements involving empty rail cars. Additionally, neither the shippers nor the rail carriers operate within a capital allocation model that addresses the problem of congestion. The shippers generally allocate new capital expenditures towards increasing their manufacturing capacity. Rail carriers generally allocate capital expenditures towards the purchase of new rolling stock/equipment and improving the mainline track infrastructure. The shippers want to focus on their core competency of making more product and the rail carriers want to focus on their core competency of the line-haul freight movement.

Within the existing business model, as described above, a primary concern in current supply chain management is the resulting congestion due to empty freight cars. A secondary concern is the build-up of product inventory associated with the congestion in the overall railroad system. Therefore, it is desirable to improve the supply chain management of rail cars. It is furthermore, desirable to reduce the congestion on trackage in the rail transportation system. It is further desirable to minimize the total number of cars within the rail transportation system.

A second problem affecting the movement of freight cars back to the loading points is due to the functions a freight car performs. Considered as an economic asset, an important feature of a railroad freight car is that it fulfills two separate functions, being both a medium of transportation, and a storage vessel. The confounding of these separate functions and possible conflicts between them must be considered in any economic analysis of the efficiency of utilization of such assets. This is a real need and not a purely academic issue, since, in actual practice, the cars are used in both modes and the producers and consumers of the product carried by the car actively exploit both functions.

The railroad carrier naturally focuses on the transportation function, and would prefer that system trackage be used minimally for the storage function, since such usage is not consistent with the carrier's desire to focus on the line-haul movement of the car. As well, storage services alone provide a reduced economic benefit to the railroad when compared to their line-haul operations, and may cause traffic congestion in existing classification yards.

In contrast to the railroad carriers' handling of freight cars for transportation of products, manufacturers and producers derive value from the freight cars as storage units. While the value of the transportation function of a rail car may be obvious, the value of its storage function must be considered in more detail. By the nature of the bulk transportation capability of railroad freight operations, manufacturing and production facilities that use railroad transportation are usually operations generating products in large quantities. Such production facilities often operate continuously 24 hours a day and 7 days a week, and cannot be started or stopped without incurring significant costs. For this reason, it is important for the plant operator to have available empty storage containers at all times ready to receive the product. It is common practice in many manufacturing operations for the production facility to use the railroad freight cars for such storage. Doing so avoids not only the capital investment in fixed on-site storage space, but also the ongoing cost of transferring the product from fixed storage to railroad cars.

The same logic applies at the receiving (i.e., consignee) end of the freight path. The users or consumers are typically operations, which must be assured of continuous availability of the product, often as feedstock to a manufacturing operation. It is common to use the loaded railroad cars as reservoirs from which material can be withdrawn as needed to keep the manufacturing operation running. The differing viewpoints and priorities of the railroad carriers and their customers may be a source of significant friction, reducing the economic performance of the distribution system as a whole.

A salient feature of this production, distribution and consumption model is that, while the production and consumption functions are generally steady-stream flow processes, the railroad transportation function is a batch process. Release rates of the unladen cars from the consignees have a high degree of variability so as to create unpredictability in the return of cars back to a producer. This erratic flow and supply of unladen cars is perpetuated by the rail carriers as they attempt to place all available cars back at the production facility and keep the cars from creating congestion within the carriers' classification yards. Therefore, under current distribution models, a plant may be lacking cars one day, then not have enough storage for inbound cars the next day. Due to the erratic nature of the empty car supply, most producers hold on-site, or ask the rail carriers to hold locally, a sufficient safety stock of cars to sustain manufacturing operations for several days, and additional quantities to span weekends or periods of rail service interruptions and shutdowns. Holding a high amount of safety stock inventory is necessitated only due to the high degree of variability in the flow of cars in the current business model. To match the manufacturing steady-stream flow processes to the variability of rail carrier performance, and to be assured of the availability of empty cars at the production plant and loaded cars at the consignee, it has been a fundamental necessity of the operators of the car fleets to increase the size of the fleets. In fact, most plastic resin producers, as an example, agree that they have an excess number of cars in their fleets to accommodate the variability in the clean car supply chain. The excess of cars further adds to the congestion within the rail carrier facilities such that the overall rail system velocity is negatively impacted. Building fleet sizes to levels greater than would optimally be required may address the acute operating need but, this practice requires capital, not just for the cars themselves, but also for storage yards and the associated infrastructure to be used for storage of the freight containers. The increase in size of the fleets also poses problems for the railroad carriers, since, inevitably, the number of cars on their tracks—in storage, in—transit, and in classification yards—increases commensurately. The resulting congestion increases the cost of transportation, causes inconsistent rail service to occur and results in a sub-optimized supply chain. Inconsistent rail service and reduced rail system velocity may motivate the producers/manufacturers to acquire yet more cars, further adding to the problem. It is therefore desirable to minimize the number of freight cars in the transportation system, while at the same time providing enough freight cars at manufacturers' and producers' facilities to prevent work stoppage at those facilities. It is further desirable to provide buffers and points of aggregation in the rail system so that producers can employ just-in-time inventory management techniques to the distribution of their products. These points of aggregation will serve to remove the variability in the flow of unladen cars coming back to manufacturers' facilities. As well, for laden cars, these facilities will serve as storage-in-transit inventory control points and is consistent with the theory of "forward deployed inventory."

A second aspect of railroad traffic operations that negatively affects the supply chain of cars is the handling of freight cars in railyards. An important cost factor in railroad freight operations is the process of sorting or switching cars, normally performed in a classification yard. This is necessary since a train consist is generally heterogeneous, with differing types of cars destined for differing final destinations. Each train consist is constructed by assembling cars headed for the same next way point in their transit plan, but not necessarily the same final destination. At each waypoint the train consist may be reclassified and the cars re-sorted to be assembled into a consist to proceed to the next waypoint. Clearly it is desirable to minimize the classification process and reduce the total number of handling events. This is done by grouping together cars which are headed for the same geographic area, so that at successive classification yards the group can be sorted as a single entity rather than handling each car individually. The process of grouping cars headed for the same final destination is termed "blocking", and is very desirable and well accepted as a method for improving the efficiency of railroad operations. Moving a series of blocked cars to the same destination in the rail system reduces the costs incurred by the rail carrier in their terminal/yard operations and increases the velocity of the overall rail.

However, important classes of freight cars are dedicated to the transportation of specific products, and such cars are frequently capital assets of the product manufacturer. The distinctions between cars relate not just to the mechanical design to handle differing materials such as solids or liquids, but to distinctions made between cars of identical design in order to address possible contamination of a shipment from traces of material remaining in a car from a preceding load. For this reason, even cars of identical design are frequently not treated as generic, homogeneous assets. In existing practice, many cars are dedicated to specific finished goods, and even within a specific manufacturing facility where the products are generated. Therefore, because of these product/container segregations and the rail carriers' practice of reverse routing of the cars, the containers are generally returned unladen to the same geographic location from which they originated their last loaded movement. The combination of reverse routing of the car, combined with product/container segregation, makes the homogeneous use of the assets problematic, even when the containers are intended for the same service/use and may even belong to the same manufacturer operating multiple production facilities.

An example of the shortcomings of the present practices for railroad traffic operations is the production and consumption of polymer resins. The majority of the production of polymer resins in the United States occurs along the Gulf coast of Texas. A polymer resin producer will typically generate production of a specific type of resin and load the output into covered hopper rail cars for transport to consignees, a large number of which are manufacturers located in the Northeast portion of the United States. Different types of polymer resins cannot be intermixed, as even a small amount of product contamination may negatively impact a consignee's manufacturing process.

The laden freight cars will make their transit from the production region to the manufacturers or consumption regions. Path planning is utilized for the outbound portion of the trip. See, U.S. Pat. Nos. 5,794,172; 5,623,413; 5,828,979; 5,836,529; and 5,797,113 (incorporated by reference). After unloading at the consignees, the empty cars are generally returned to the originating production plant using the same outbound routing. The velocity of inbound rail car movements reduces greatly as the cars near the loading points—going through multiple exchanges, classifications, and blocks before being delivered back to a shipper's plant site. As can be appreciated, this transportation system is inefficient, costly, and undesirable. Inbound empty transit times can be 10-25% longer than outbound loaded times. It is therefore desirable to provide a system for the efficient return of unladen cars back to the originating production plants.

Furthermore, nearly all plastics producers clean their hopper cars after each trip and prior to loading. Such railcar cleaning is typically done at the plant site, but occasionally through off-site shops or repair facilities. The cleaning procedures vary little from producer to producer and could be standardized. Many plastics producers also have in-plant rail car maintenance shops, which may have limited repair capabilities and little capacity. These existing rail car maintenance operations may lack uniformity in processes and procedures, quality of work, and record keeping. It is therefore desirable to provide a system for standardized cleaning, inspection, repair and maintenance of railcars, along with reliable record keeping.

SUMMARY OF THE INVENTION

The problems described above are largely solved by the system, network, and methods in accordance with the present invention. The invention provides a system and a method, which improves the efficiency of utilization of railroad freight cars particularly.

The system involves the provision of one or more storage-in-transit aggregation yards in which railroad freight cars can be cleaned, repairs and maintenance can be performed, and where cars can be efficiently blocked for delivery to common final destinations. The method differs from current practice in two respects: firstly that, after cleaning, functionally similar cars can be treated as generic and homogeneous rather than being dedicated to a specific product or production facility, and secondly that the transit path for return of empty cars may not be a simple reversal of the loaded path, but rather will route cars to facilities in a discretionary manner.

Broadly speaking, the method of managing the freight railway system in accordance with the present invention is particularly useful for transporting materials having different species from a production region to a manufacturing region. The terms "production" and "manufacturing" may be used interchangeably in many contexts. The method contemplates first loading a plurality of freight cars in the production region with materials where a single species of the class of materials is loaded in a specific freight car container. The freight cars are moved to the manufacturing region and unloaded. The unladen freight cars are then moved to one of several aggregation facilities where they are processed in such a fashion that the cars may be loaded with a new species of material. The processed freight cars are then moved back to the production area where they can be re-used. Advantageously, after processing, the freight cars are "generic" meaning they can be used by any species of the class of materials and could be utilized by different manufacturing facilities and by different manufacturers. Preferably, the aggregation facilities are geographically intermediate between the production and manufacturing regions in a freight railway system and include the capabilities for storing, cleaning, performing repairs/maintenance and inspections on the cars and blocking of the cars for the rail carriers.

More generally, the system hereof contemplates the movement of multiple materials in a transportation network where the materials cannot be intermixed in transit. Such a system includes one or more production facilities of a material in a geographic region. A plurality of containers is provided for accepting materials where each container accepts a single material i.e. there is not cross contamination of different materials in the same container. The laden containers are moved through one or more transit paths from production facilities to manufacturing facilities in another geographic region. After unloading the containers, an aggregation facility is provided along the transportation network and includes a cleaning system for enabling any container to accept any materials without fear of contamination. The aggregation facility is further capable of storing the unladen containers until a production facility needs them.

DESCRIPTION OF ILLUSTRATIVE EMBODIMENTS

The present invention overcomes the shortcomings of the prior art by providing a system and method for processing and distributing freight containers. Advantages to the present invention include a decrease in capital investments in additional rail cars, trackage, and land. The present invention also provides a standardized method for cleaning cars within an aggregation facility. As well, the present invention optimizes the flow of traffic such that rail car cleaning, inspecting, repairing and certification can take place within a single facility. The present invention is adaptable for use with loaded or unloaded freight cars and other transportation means, including ISO containers, airfreight containers and intermediate containers. For illustrative purposes, a specific instance of the facilities and operation of the invention is described as it relates to covered hopper cars used for the conveyance of polymer resins. However, it will be readily apparent that the principles illustrated by the specific case are applicable to a broad range of railroad freight cars types and other containers carrying a wide range of bulk products that could otherwise become mixed with any incompatible products previously loaded into the container absent the processing described herein. Even for a product of relative value such as polymer resins, transportation/distribution costs are a substantial component in the costs of finished goods.

Figure 1:
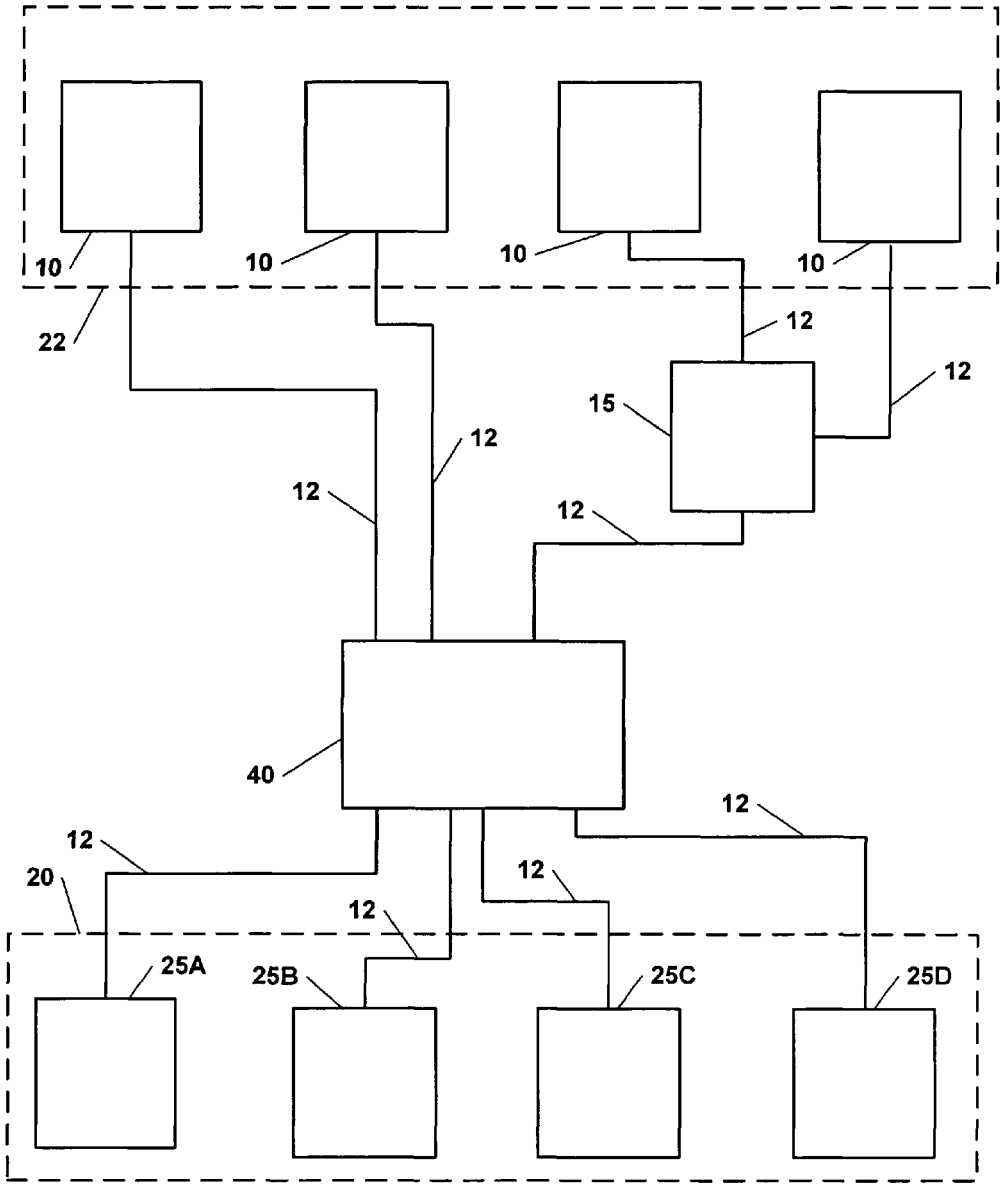
FIG. 1 is a schematic diagram showing the connectivity of the lines of a railroad network.

Referring to the Figures, FIG. 1 is a diagram of the concept of supply chain management implemented by the present invention as it pertains to the return of empty freight cars from manufacturers 10 to producers 25 on railway lines 12. Freight cars leave the manufacturers 10, typically located in manufacturing region 22, and aggregate at aggregation facility 40. Alternatively, freight cars may stop at an intermediate waypoint 15 before moving to aggregation facility 40. Once at aggregation facility 40, the freight cars are inspected and cleaned, as well as repaired if necessary, and stored before eventually returning to any of producers 25 located in production region 20. As opposed to the current business model in which cars are moved to producers 25 with a high degree of variability, under the current invention, cars will only be pulled out of storage at aggregation facility 40 when they have been specifically called for by producers 25.

Figure 2:
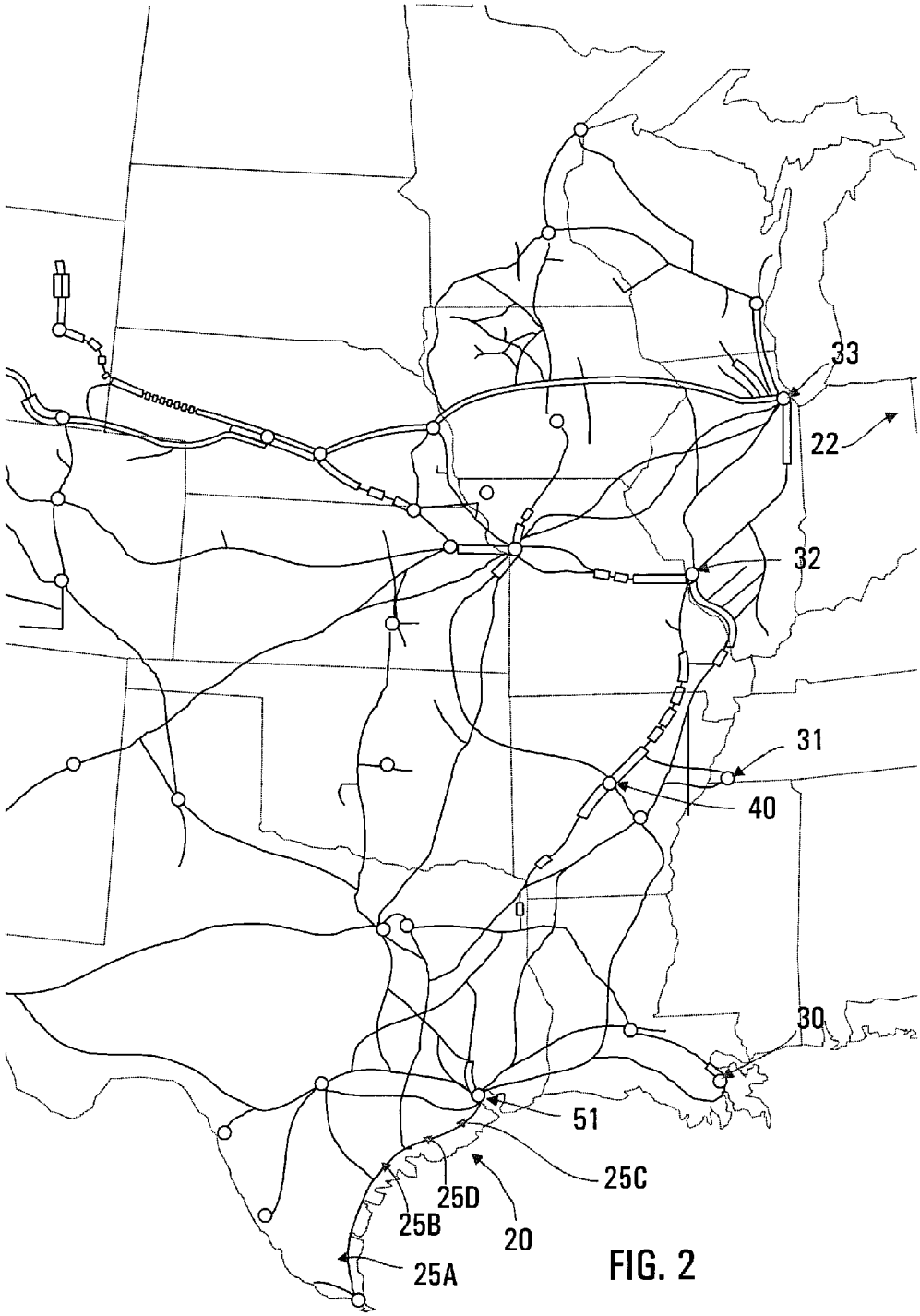
FIG. 2 is an atlas of selective rail systems in the United States.

In one embodiment of the present invention, FIG. 2 shows the major routes of a railroad system serving the region 20 where the plastic resin is produced, the Gulf Coast of the United States in this case. In this embodiment the consumption or manufacturing region 22 is the Northeast portion of the United States.

Also indicated in FIG. 2 are four gateway points: New Orleans 30, Memphis 31, Saint Louis 32 and Chicago 33. At these points shipments destined for final delivery to users in the Northeastern USA are transferred to different railroad carriers serving the final destination regions, and therefore gateways 30, 31, 32 and 33 constitute possible waypoints 15 in the total transit route for shipments from the Gulf Coast or some other production region 20 to the Northeast or any other manufacturing region 22. Gateways 30, 31, 32 and 33 also feature in the return path planning for unladen cars returning to production plants 25 in the Gulf Coast region 20, being points where the cars are transferred from Eastern railroads to the rail-roads serving the Gulf Coast.

Also indicated in FIG. 2 is a possible car aggregation and processing facility 40. The selection of the geographic location for aggregation facility 40 is important to the successful operation of the system. In this case, the selection lies on an efficient transit path between the consignees points served by gateways 30, 31, 32, and 33, and any of the product manufacturing plants 25 in region 20. However, it is desirable to dispatch the empty cars such that the inventory of cars in transit acts as a buffer between the consignees and loading points.

Benefits of the use of aggregation facilities, such as facility 40, are that all empty cars entering the railroad network can be routed in a discretionary manner to destinations of the car operator's choosing. The cars reenter the railroad network from storage only at the specific request by a production facility. Having the cars cleaned to a common standard allows the cars to be used by multiple facilities controlled by a single manufacturer or allows multiple manufacturers to pool their collective fleet assets to further optimize the supply chain. Having the cars blocked by their final intended destinations prior to release to the delivering rail carrier reduces the total number of handling events the cars must endure. This service improves the efficiency of the serving rail carrier and increases the velocity of cars in the rail distribution network.

FIG. 2 further illustrates the locations of specific production plants 25A, 25B, 25C, and 25D in the Gulf Coast region, in relationship to the rail network. Each plant produces many, perhaps hundreds, species of specific products within the same general class such as polymer resins. For instance, plant 25A may manufacture polypropylene, plant 25B may manufacture polyethylene, plants 25C and 25D may also manufacture polyethylene but with products of the same or differing chemical properties from plant 25B, and so forth. Plants 25A, 25B, 25C, and 25D may be operated by the same manufacturer or multiple manufacturers. Importantly, we note that while the product resins may appear the same to casual observation, their physical and chemical characteristics, such as melting temperature, may be significantly different in ways that would cause serious problems for users of these products if even a few pellets of a different composition were to contaminate a shipment.

Figure 3A:
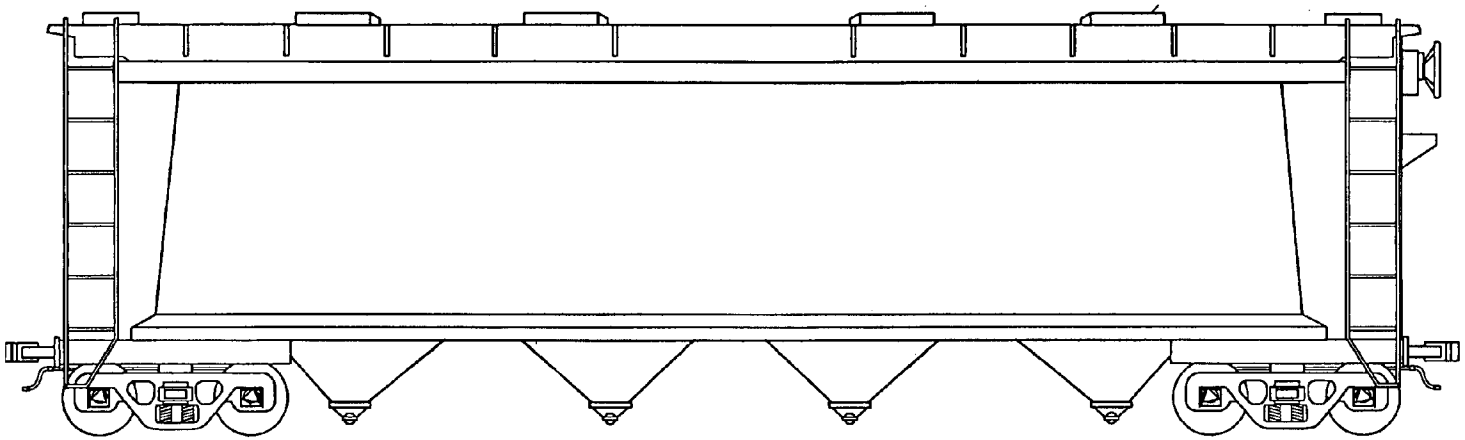
FIG. 3A is a side view illustrating the major construction and functional features of a covered hopper railroad freight car.
Figure 3B:
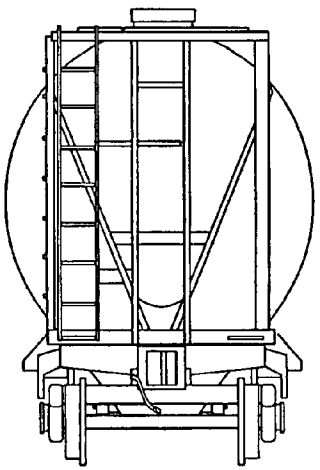
FIG. 3B is an end view of the freight car of FIG. 3A.

FIGS. 3A and 3B are end and side views of a typical covered hopper freight car as mentioned in this document. The car is loaded from the top through hatches. After loading is complete, all openings are closed and sealed to protect the load from contamination during storage and transit. Unloading is accomplished by opening the pneumatic outlet valves at the bottom of the car, allowing the load to flow by a combination of gravity and air assistance from the bottom of the car and into receiving vessels. The walls of the main carrying cavities are shaped to allow free flow of pelletized or granular material to the outlet gates at the bottom of the car body.

Each car generally carries one species of material, and for successful operation of the system, the main body of the car and all the surfaces with which the material may contact must be cleaned of all residue traces of the previous cargo and any foreign material, such as rainwater, which may have entered the car between unloading and arrival back at a manufacturing plant.

In addition to car maintenance functions, such as safety appliance repair/replacement, items such as the integrity of the air braking system, couplers, and wheel bearings, and the hatches and the pneumatic outlets, must be inspected and repaired or replaced so that the cleanliness and operating integrity of the car can be assured between processing at the aggregation facility and loading at a manufacturing facility.

Figure 4A:
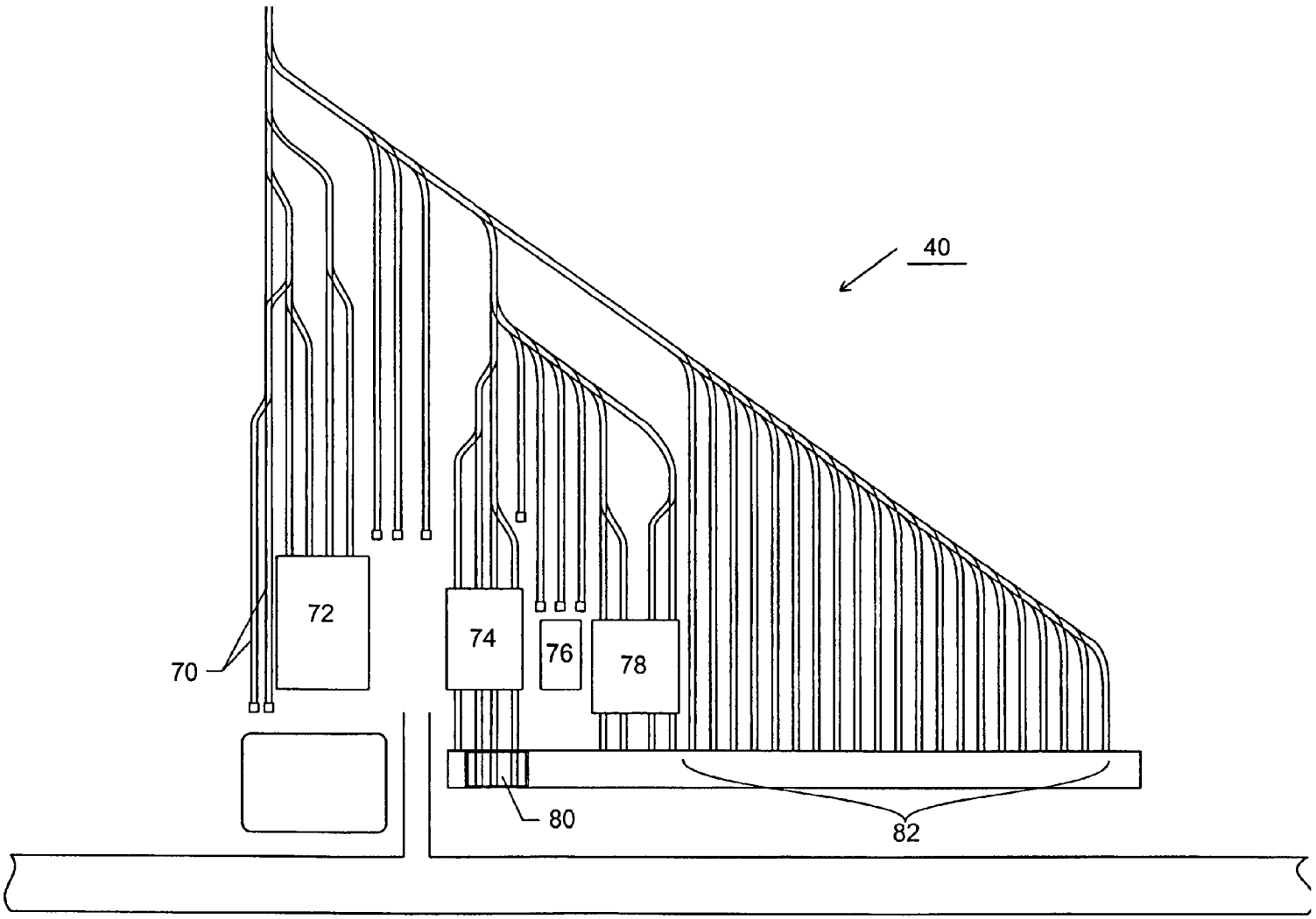
FIG. 4A is a layout diagram illustrating conceptually the major physical features of a representative centralized freight car aggregation and storage facility.
Figure 4B:
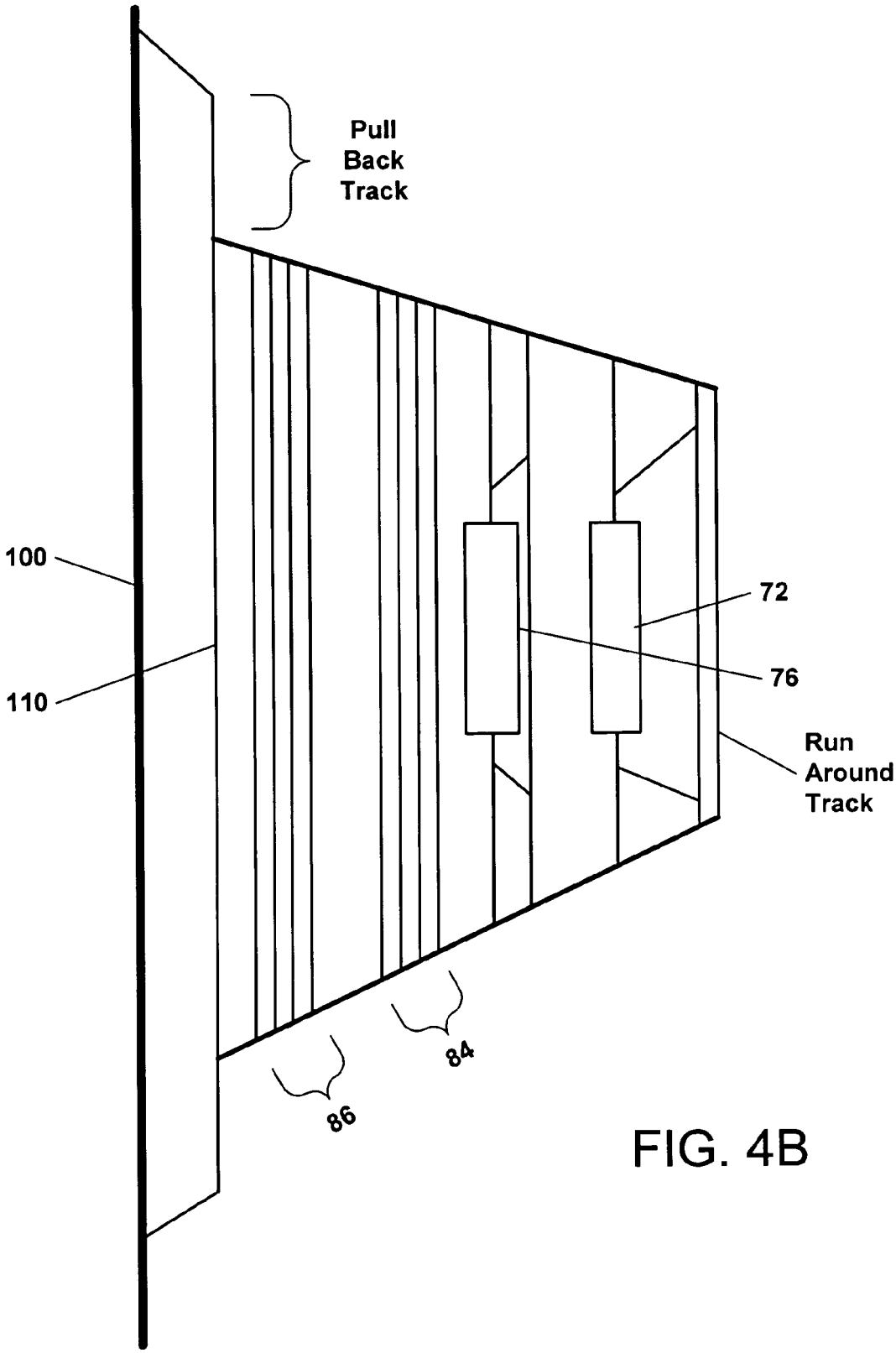
FIG. 4B is a layout of a preferred embodiment of the aggregation facility of the present invention.

FIGS. 4A and 4B illustrate different embodiments of the facilities provided at the aggregation facility 40. FIG. 4A illustrates one embodiment of the facilities provided at the aggregation facility 40 of FIG. 1. In FIG. 4A, cars entering the aggregation facility 40 are placed in the incoming staging area 70, where they are inspected and sorted. If inspection reveals a need for repair, or records indicate that scheduled maintenance is due, a car will be routed to the repair and maintenance area 72.

Once a car has passed inspection, it is then passed to the cleaning staging area 74, from which cars are drawn to pass through the wash and dry processes in buildings 76 and 78. For cars dedicated to transport of polymer pellets, cleaning may be accomplished by water wash followed by forced air drying, but for other types of freight cars different cleaning methods may be required, such as solvent or detergent wash. The cleanliness of the car is inspected, and the fill hatches and pneumatic outlets are closed and sealed, before the car leaves the cleaning area.

The car is then moved by the lateral transfer table conveyor 80 to the outgoing staging and blocking area 82. At this point it has become a generic homogeneous, car capable of handling loads from any of the production facilities, and for use by any of the manufacturers of the same product species, rather than being dedicated to a specific plant. It can therefore be handled without further sorting until re-loaded. Cars are withdrawn as needed and made up into blocked consists for transit via the rail carriers to the production facilities.

FIG. 4B shows a preferred embodiment of the present invention. However, those skilled in the art will appreciate that the embodiment shown in FIG. 4A may have certain advantages in areas in which an aggregation facility 40 is desired but there is insufficient land to provide the aggregation facility 40 shown in FIG. 4B.

In FIG. 4B, aggregation facility 40 is connected to mainline track 100 by way of receiving track 110. Freight cars brought into aggregation facility 40 are moved onto a track in storage area 84 or 86 until such time as the freight cars are processed. During processing, the cars are moved into inspection and repair facility 72. After the cars have had any necessary repairs or other maintenance, they are then moved to cleaning facility 76. Once the cars have been processed through cleaning facility 76, they are stored again in either storage area 84 or 86. Advantageously, the cleaned cars may be blocked in storage areas 84 and 86 so that no additional moves are needed before the cars leave the aggregation facility 40 as a unit train.

Aggregation of cars at the yard 40, and their generic nature after cleaning, increases the probability that entire consists can be composed of equivalent cars; such a consist is termed a unit train. A unit train, in many cases, allows the entire train to be passed over the railroad network without further sorting or classifying. It greatly increases the efficiency of the rail distribution system since, not only is the re-sorting process reduced or eliminated but, it allows the consist to travel with minimum delay.

In another embodiment (not shown), aggregation facility 40 is located on a mainline track near a storage-in-transit facility. Locating the aggregation facility 40 near a storage-in-transit (SIT) facility may improve the buffering of the system on the transportation system.

The capability for the aggregation facility to block cars into generic consists greatly reduces the need for rail carriers to perform blocking and switching operations and, instead, focus their resources on moving the consists from point A to point B. Furthermore, with the capability of the aggregation facility to form generic consists, the aggregation yard becomes a highly efficient buffer in the supply chain of cars. Instead of storing largely dedicated cars on their own tracks or paying a rail carrier to store the cars for them, producers may schedule delivery of generic rail cars for use in just-in-time production models. One effect of just-in-time car supply would be a further decrease in congestion at rail carrier terminal facilities, further improving the velocity of the rail distribution system.

At production facilities which generate multiple products types, the fact that the incoming cars are generic and not dedicated to a specific product allows reduction of the number of empty cars which must be stored to ensure availability of cars to receive each product. Such a reduction in the number of cars that must be stored facilitates the elimination of surplus cars in the overall fleet of cars.

As can be appreciated from the above discussion of a preferred embodiment, the system and method hereof can be generalized to transportation networks, in particular where cross contamination of materials is problematic. That is, while the above embodiment discusses the implementation in a freight railcar transportation system, the invention may be applicable to trucking systems and other transportation systems such as aircraft where the containers for materials are modularized and suitable for only carrying a single class of materials. Those skilled in the art will readily appreciate variations hereof without departing from the spirit and scope of the present invention.

What is claimed:

1. A method of managing the transportation in a network of different species of a class of materials from a production region to a manufacturing region comprising:

a) loading a plurality of bulk containers in the production region with said materials, a single species of said class of materials being loaded in a specific container;

b) moving said containers to said manufacturing region and unloading said containers;

c) moving said unloaded containers to an aggregation facility;

d) processing said unloaded containers in said aggregation facility in such fashion that any processed container may be subsequently loaded with any species of said class of material regardless of any incompatible material from said class of materials previously loaded into the container; and e) moving said processed containers to any production facility in said production region, said production facility using one or more species of said class of material.

2. The method of claim 1, said processing step including cleaning each unloaded container to substantially remove the residue of the species of material from each container from the previous loaded movement.

3. The method of claim 1, said processing step including inspecting and repairing at least some of said unloaded containers.

4. The method of claim 1, including storing said processed containers at said aggregation facility until said processed containers are needed in said production region.

5. The method of claim 4, including the step of blocking a plurality of processed containers at said aggregation facility for movement to any production facility in said production region, said production facility producing said species of said class of material.

6. The method of claim 1, the production region being geographically separated from said manufacturing region.

7. The method of claim 1, said loading step a) occurring at a particular production facility in said production region, said moving step e) including moving said processed containers to another production facility in said production region.

8. The method of claim 1, wherein said step of moving said containers to said manufacturing region and unloading said containers further comprises the step of storing said containers at a storage-in-transit yard associated with said aggregation facility.

9. The method of claim 1, wherein said network comprises a railway system.

10. The method of claim 9, said aggregation facility being generally geographically intermediate in said freight railway system between said production region and said manufacturing region.

11. The method of claim 9, wherein said containers comprise railroad freight cars.

12. The method of claim 9, wherein said containers comprise railroad tank cars.

13. The method of claim 1, wherein said class of materials comprises solids.

14. The method of claim 13, said class of materials comprising polymer resin.

15. The method of claim 1, wherein said class of materials comprises fluids.

16. A system for movement of multiple species of a class of materials in a transportation network, where said species of materials cannot be intermixed in transit, comprising:

a) one or more production facilities of said class of materials in a geographic region;

b) a plurality of containers for accepting said materials, each container accepting a single species of bulk material;

c) one or more paths for movement of said containers loaded with material from said production facilities to manufacturing facilities in another geographic region, each container being unloaded in said manufacturing region;

d) one or more paths for movement of said unloaded containers from said manufacturing region to said production region; and e) an aggregation facility connected to said paths in said transportation network, including a cleaning system enabling any container to subsequently accept any species of said class of material thereby rendering said containers generic as to any species within said class of materials.

17. The system of claim 16, wherein said class of materials is polymer resin.

18. The system of claim 16, said transportation network comprising a railway system and said containers comprising rail cars.

19. The system of claim 16, said manufacturing and production regions being geographically separated.

20. The system of claim 16, said aggregation facility being geographically intermediate between said manufacturing and production regions.

21. The system of claim 16, said aggregation facility including a storage area for storing cleaned containers until needed in said production region.

22. The system of claim 16, including a storage facility for storing containers in said production region.

23. The system of claim 16, further comprising a storage-in-transit yard for loaded cars associated with the aggregation facility.

24. A railway network having a number of production facilities in a geographic production region for producing a number of species of a class of bulk materials which cannot be mixed for shipment and a number of manufacturing facilities which use such materials in a geographically remote manufacturing region, the improvement comprising:

an aggregation facility located on said railway network and intermediate to said production region and said manufacturing region for accepting unloaded shipping containers, said unloaded shipping containers having residue of previously shipped materials, said facility including systems for cleaning, repairing, and storing said clean containers for movement to said production region and reuse of the clean containers with subsequent loading of any type of material within the class regardless of any incompatible material from said class of materials previously loaded into the container, and storing said loaded containers for movement to said manufacturing region.

25. The network of claim 24, said containers comprising railroad freight cars.

26. The network of claim 24, said containers comprising railroad tank cars.

27. The network of claim 24, said storing system comprising a storage area where rail cars are blocked for transport as a block to a particular production facility where needed.

28. The network of claim 24, the materials comprising a plurality of types and sizes of polymer resins.

29. The network of claim 24, said facility including systems for inspecting, cleaning, repairing, switching, blocking and classifying said containers.

30. The method of claim 1, wherein the subsequently and previously loaded materials are of the same class.

31. The method of claim 1, wherein said processing step renders said containers generic with respect to said class of materials.

32. The network of claim 24, wherein said systems for cleaning render said containers generic with respect to said class of materials.

* * * * *